US009310816B2

(12) United States Patent
Chang et al.

(10) Patent No.: US 9,310,816 B2
(45) Date of Patent: Apr. 12, 2016

(54) IMMEDIATE RESPONSE LOW DROPOUT REGULATION SYSTEM AND OPERATION METHOD OF A LOW DROPOUT REGULATION SYSTEM

(71) Applicant: Etron Technology, Inc., Hsinchu (TW)

(72) Inventors: Yen-An Chang, Miaoli County (TW); Kuang-Fu Teng, Ping-Tung County (TW); Der-Min Yuan, New Taipei (TW)

(73) Assignee: Etron Technology, Inc., Hsinchu (TW)

( * ) Notice: Subject to any disclaimer, the term of this patent is extended or adjusted under 35 U.S.C. 154(b) by 405 days.

(21) Appl. No.: 13/787,823

(22) Filed: Mar. 7, 2013

(65) Prior Publication Data

US 2013/0234684 A1 Sep. 12, 2013

Related U.S. Application Data

(60) Provisional application No. 61/608,650, filed on Mar. 9, 2012.

(51) Int. Cl.

| | |
|---|---|
| ***G05F 1/00*** | (2006.01) |
| ***G05F 1/46*** | (2006.01) |
| ***G05F 1/575*** | (2006.01) |

(52) U.S. Cl.

CPC ..... *G05F 1/468* (2013.01); *G05F 1/575* (2013.01)

(58) Field of Classification Search

CPC ..... G05F 1/468; G05F 1/613; G05F 1/59; G05F 1/575; G05F 1/56

USPC ..... 323/226, 269, 270, 273, 274, 275, 280, 323/281, 303

See application file for complete search history.

(56) References Cited

U.S. PATENT DOCUMENTS

| | | | | |
|---|---|---|---|---|
| 6,188,212 | B1 * | 2/2001 | Larson | G05F 1/56 323/274 |
| 7,336,058 | B1 * | 2/2008 | Lo et al. | 323/269 |
| 7,554,309 | B2 * | 6/2009 | Carpenter et al. | 323/282 |
| 7,960,955 | B2 * | 6/2011 | Ito et al. | 323/281 |
| 2008/0224679 | A1 * | 9/2008 | Sahni et al. | 323/284 |
| 2010/0141223 | A1 * | 6/2010 | Wadhwa | 323/280 |
| 2011/0181259 | A1 * | 7/2011 | Shen | 323/282 |
| 2013/0033244 | A1 * | 2/2013 | Ock | G05F 1/56 323/280 |
| 2013/0162233 | A1 * | 6/2013 | Marty | H02M 3/158 323/274 |

FOREIGN PATENT DOCUMENTS

| | | |
|---|---|---|
| TW | 200825651 | 6/2008 |
| TW | 201126300 | 8/2011 |

* cited by examiner

*Primary Examiner* — Adolf Berhane
*Assistant Examiner* — Alex Torres-Rivera
(74) *Attorney, Agent, or Firm* — Winston Hsu; Scott Margo

(57) ABSTRACT

An immediate response low dropout regulation system includes a low dropout regulation unit, a tracking voltage generation unit, and a self-driving unit. The low dropout regulation unit is used for generating and outputting an inner output voltage according to a reference voltage. The tracking voltage generation unit is used for generating and outputting a tracking voltage according to the reference voltage. The self-driving unit is coupled to the low dropout regulation unit and the tracking voltage generation unit. When a voltage difference between the tracking voltage and the inner output voltage is greater than a constant times threshold voltage, the self-driving unit provides a compensation current to an output terminal of the low dropout regulation unit.

34 Claims, 8 Drawing Sheets

IMMEDIATE RESPONSE LOW DROPOUT REGULATION SYSTEM AND OPERATION METHOD OF A LOW DROPOUT REGULATION SYSTEM

CROSS REFERENCE TO RELATED APPLICATIONS

This application claims the benefit of U.S. Provisional Application No. 61/608,650, filed on Mar. 9, 2012 and entitled "Immediate Response LDO Regulator," the contents of which are incorporated herein by reference.

BACKGROUND OF THE INVENTION

1. Field of the Invention

The present invention relates to a low dropout regulation system and an operation method of a low dropout regulation system, and particularly to a low dropout regulation system and an operation method of a low dropout regulation system that can immediately respond to variation of an inner output voltage.

2. Description of the Prior Art

Please refer to FIG. 1. FIG. 1 is a diagram illustrating a low dropout regulator 100 according to the prior art. The low dropout regulator 100 includes a P-type metal-oxide-semiconductor transistor 102, an operational amplifier 104, a first resistor 106, and a second resistor 108. As shown in FIG. 1, the P-type metal-oxide-semiconductor transistor 102, the operational amplifier 104, the first resistor 106, and the second resistor 108 generate and output an inner output voltage VINT according to a reference voltage VREF and equation (1), where the operational amplifier 104 can regulate the inner output voltage VINT according to the reference voltage VREF through the P-type metal-oxide-semiconductor transistor 102.

$$VINT=VRE*[(R1+R2)/R2] \quad (1)$$

As shown in equation (1), R1 is a resistance of the first resistor 106 and R2 is a resistance of the second resistor 108. However, because the low dropout regulator 100 utilizes the P-type metal-oxide-semiconductor transistor 102 to be a driving device, and utilizes the operational amplifier 104 to regulate the inner output voltage VINT according to the reference voltage VREF, the low dropout regulator 100 has disadvantages as follows: first, if a load 110 coupled to the low dropout regulator 100 needs a large transient current, the operational amplifier 104 can not immediately respond to regulate the inner output voltage VINT and the P-type metal-oxide-semiconductor transistor 102 cannot immediately provide the large transient current, resulting in the inner output voltage VINT being quickly decreased; second, if a capacitance of the load 110 coupled to the low dropout regulator 100 is too small, the low dropout regulator 100 has bad zero/pole compensation, resulting in the low dropout regulator 100 being unstable; and third, if the low dropout regulator 100 operates in a supply voltage VDD with large variation, the low dropout regulator 100 can not provide a fixed driving current to the load 110.

SUMMARY OF THE INVENTION

An embodiment provides an immediate response low dropout regulation system. The low dropout regulation system includes a low dropout regulation unit, a tracking voltage generation unit, and a self-driving unit. The low dropout regulation unit is used for generating and outputting an inner output voltage according to a reference voltage. The tracking voltage generation unit is used for generating a tracking voltage according to the reference voltage. The self-driving unit is coupled to the low dropout regulation unit and the tracking voltage generation unit, where when a voltage difference between the tracking voltage and the inner output voltage is greater than constant times of a threshold voltage, the self-driving unit provides a compensation current to an output terminal of the low dropout regulation unit.

Another embodiment provides an immediate response low dropout regulation system. The low dropout regulation system includes a low dropout regulation unit, a tracking voltage generation unit, and a self-driving unit. The low dropout regulation unit is used for generating and outputting an inner output voltage according to a reference voltage. The tracking voltage generation unit is used for generating a first tracking voltage and a second tracking voltage according to the reference voltage. The self-driving unit is coupled to the low dropout regulation unit and the tracking voltage generation unit, where when a voltage difference between the first tracking voltage and the inner output voltage is greater than constant times of a first threshold voltage, the self-driving unit provides a first compensation current to the output terminal of the low dropout regulation unit; and when a voltage difference between the inner output voltage and the second tracking voltage is greater than constant times of a second threshold voltage, the self-driving unit sinks a second compensation current from the output terminal of the low dropout regulation unit.

Another embodiment provides an operation method of a low dropout regulation system, where the low dropout regulation system includes a low dropout regulation unit, a tracking voltage generation unit, and a self-driving unit. The operation method includes the low dropout regulation unit generating and outputting an inner output voltage according to a reference voltage; the tracking voltage generation unit generating a first tracking voltage according to the reference voltage; and the self-driving unit executing a corresponding operation according to the inner output voltage and the first tracking voltage.

The present invention provides an immediate response low dropout regulation system and an operation method of a low dropout regulation system. The low dropout regulation system and the operation method utilize a tracking voltage generation unit to generate a tracking voltage, or a first tracking voltage and a second tracking voltage. Then, a self-driving unit can generate a compensation current to regulate an inner output voltage according to the inner output voltage and the tracking voltage, or according to the inner output voltage, the first tracking voltage, and the second tracking voltage. Therefore, the present invention has advantages as follows: first, when a load coupled to a low dropout regulation unit needs a large transient current, the self-driving unit can immediately provide the compensation current to an output terminal of the low dropout regulation unit to regulate the inner output voltage; second, because the self-driving unit can immediate respond to variation of the inner output voltage, the present invention does not need an additional feedback mechanism; third, because the self-driving unit can immediate provide the compensation current to the output terminal of the low dropout regulation unit, the low dropout regulation unit can provide a stable driving current to the load; fourth, because the self-driving unit can immediate provide the compensation current to the output terminal of the low dropout regulation unit, the low dropout regulation unit has better phase margin and stability; and fifth, the present invention does not need special process metal-oxide-semiconductor transistors.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
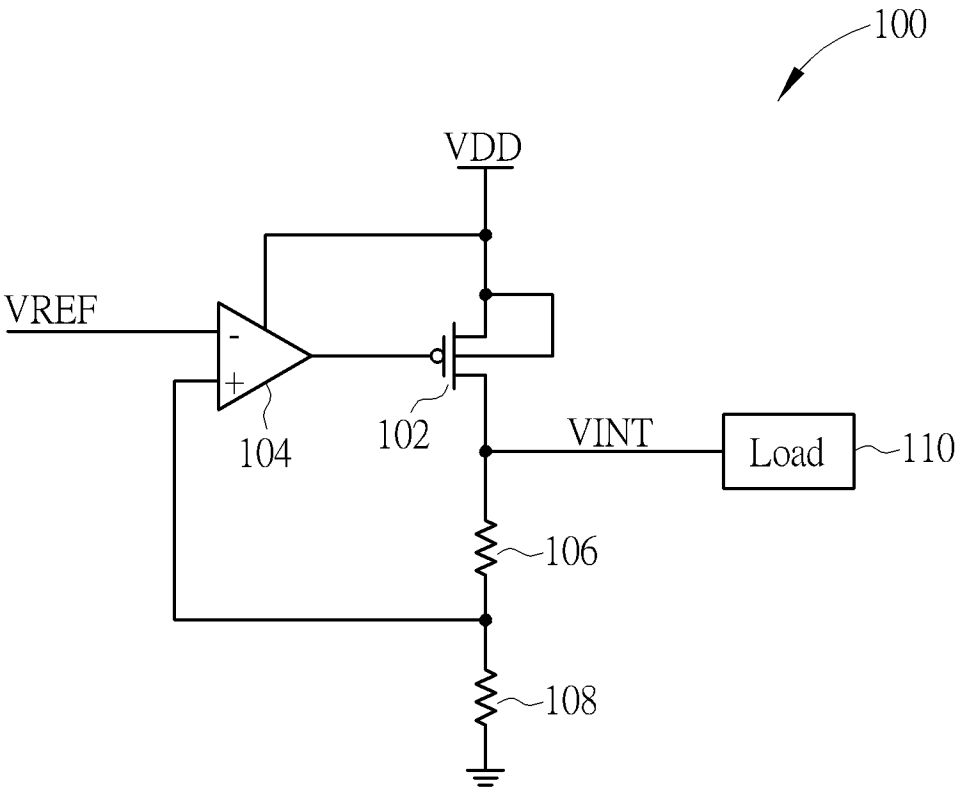
FIG. 1 PRIOR ART
FIG. 1 is a diagram illustrating a low dropout regulator according to the prior art.
Figure 2:
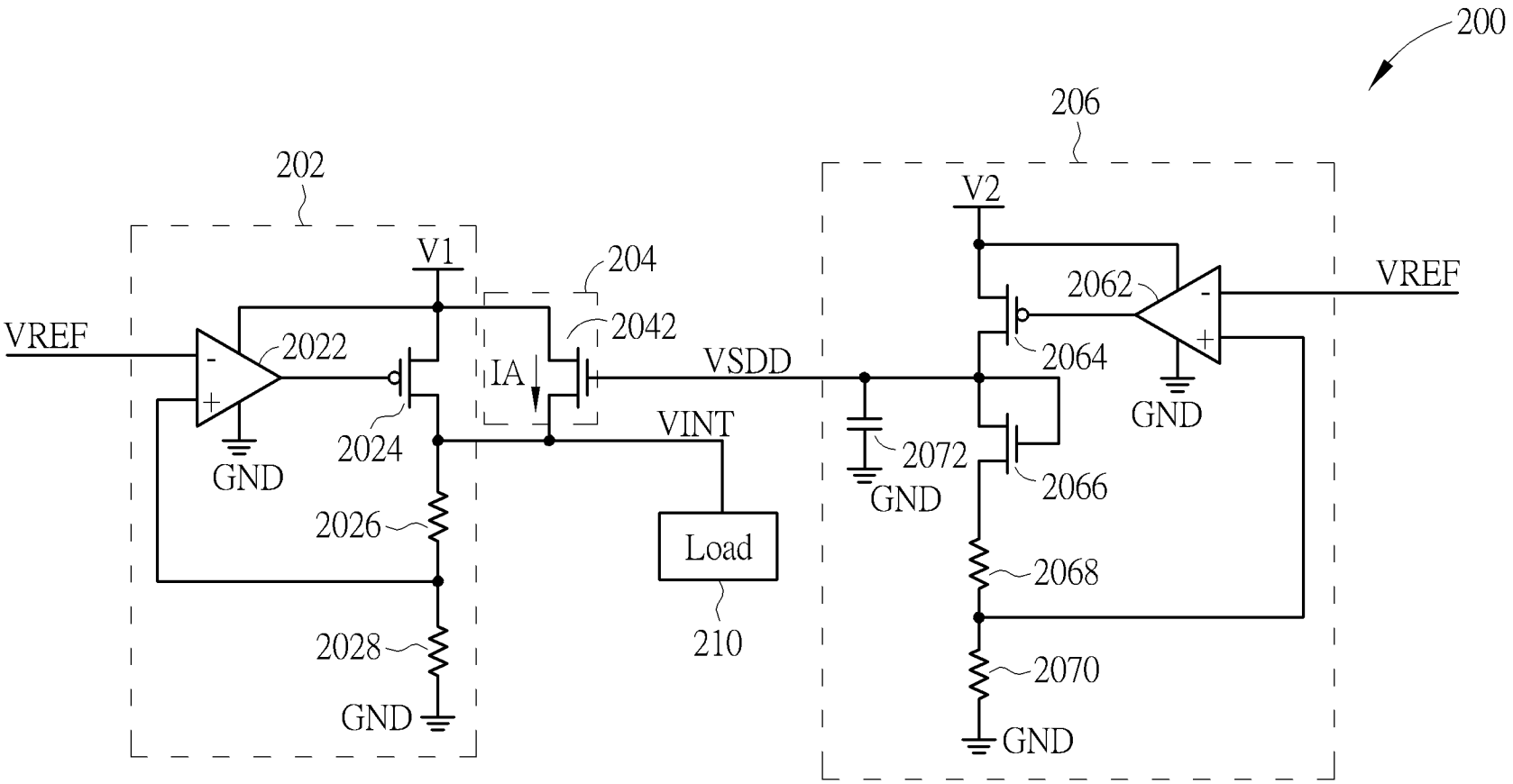
FIG. 2 is a diagram illustrating an immediate response low dropout regulation system according to an embodiment.

Please refer to FIG. 2. FIG. 2 is a diagram illustrating an immediate response low dropout regulation system 200 according to an embodiment. As shown in FIG. 2, the low dropout regulation system 200 includes a low dropout regulation unit 202, a self-driving unit 204, and a tracking voltage generation unit 206. The low dropout regulation unit 202 is used for generating and outputting an inner output voltage VINT according to a reference voltage VREF. The tracking voltage generation unit 206 is used for generating a tracking voltage VSDD according to the reference voltage VREF. The self-driving unit 204 is coupled to the low dropout regulation unit 202 and the tracking voltage generation unit 206, where when a voltage difference between the tracking voltage VSDD and the inner output voltage VINT is greater than constant times of a threshold voltage, the self-driving unit 204 provides a compensation current IA to an output terminal of the low dropout regulation unit 202.

As shown in FIG. 2, the low dropout regulation unit 202 includes a first operational amplifier 2022, a first P-type metal-oxide-semiconductor transistor 2024, a first resistor 2026, and a second resistor 2028. The first operational amplifier 2022 has a first terminal for receiving a first voltage V1, a second terminal coupled to ground GND, a negative input terminal for receiving the reference voltage VREF, a positive input terminal, and an output terminal. The first P-type metal-oxide-semiconductor transistor 2024 has a first terminal for receiving the first voltage V1, a second terminal coupled to the output terminal of the first operational amplifier 2022, and a third terminal for outputting the inner output voltage VINT. The first resistor 2026 has a first terminal coupled to the third terminal of the first P-type metal-oxide-semiconductor transistor 2024, and a second terminal coupled to the positive input terminal of the first operational amplifier 2022. The second resistor 2028 has a first terminal coupled to the second terminal of the first resistor 2026, and a second terminal coupled to the ground GND. The self-driving unit 204 includes a first N-type metal-oxide-semiconductor transistor 2042. The first N-type metal-oxide-semiconductor transistor 2042 has a first terminal for receiving the first voltage V1, a second terminal for receiving the tracking voltage VSDD, and a third terminal coupled to the third terminal of the first P-type metal-oxide-semiconductor transistor 2024.

As shown in FIG. 2, the tracking voltage generation unit 206 includes a second operational amplifier 2062, a second P-type metal-oxide-semiconductor transistor 2064, a second N-type metal-oxide-semiconductor transistor 2066, a third resistor 2068, a fourth resistor 2070, and a stabilization capacitor 2072. The second operational amplifier 2062 has a first terminal for receiving a second voltage V2, a second terminal coupled to the ground GND, a negative input terminal for receiving the reference voltage VREF, a positive input terminal, and an output terminal. The second P-type metal-oxide-semiconductor transistor 2064 has a first terminal for receiving the second voltage V2, a second terminal coupled to the output terminal of the second operational amplifier 2062, and a third terminal coupled to the second terminal of the first N-type metal-oxide-semiconductor transistor 2042 for outputting the tracking voltage VSDD. The second N-type metal-oxide-semiconductor transistor 2066 has a first terminal coupled to the third terminal of the second P-type metal-oxide-semiconductor transistor 2064, a second terminal coupled to the first terminal of the second N-type metal-oxide-semiconductor transistor 2066, and a third terminal. The third resistor 2068 has a first terminal coupled to the third terminal of the second N-type metal-oxide-semiconductor transistor 2066, and a second terminal coupled to the positive input terminal of the second operational amplifier 2062. The fourth resistor 2070 has a first terminal coupled to the second terminal of the third resistor 2068, and a second terminal coupled to the ground GND. The stabilization capacitor 2072 has a first terminal coupled to the third terminal of the second P-type metal-oxide-semiconductor transistor 2064, and a second terminal coupled to the ground GND, where the stabilization capacitor 2072 is used for stabilizing the tracking voltage VSDD.

In addition, the first N-type metal-oxide-semiconductor transistor 2042 and the second N-type metal-oxide-semiconductor transistor 2066 have the same process structure. For example, the first N-type metal-oxide-semiconductor transistor 2042 and the second N-type metal-oxide-semiconductor transistor 2066 can be a normal type N-type metal-oxide-semiconductor transistor. But, the present invention is not limited to the first N-type metal-oxide-semiconductor transistor 2042 and the second N-type metal-oxide-semiconductor transistor 2066 being a normal type N-type metal-oxide-semiconductor transistor. Moreover, a ratio of the first resistor 2026 to the second resistor 2028 is equal to a ratio of the third resistor 2068 to the fourth resistor 2070.

As shown in FIG. 2, when the first P-type metal-oxide-semiconductor transistor 2024 operates in a saturation region, a voltage of the positive input terminal of the first operational amplifier 2022 is equal to the reference voltage VREF. Therefore, the inner output voltage VINT can be generated according to equation (1). In addition, when the second P-type metal-oxide-semiconductor transistor 2064 operates in a saturation region, a voltage of the positive input terminal of the second operational amplifier 2062 is equal to the reference voltage VREF. Therefore, the tracking voltage VSDD can be generated according to equation (1) and equation (2):

$$\begin{aligned} VSDD &= VREF * [(R3 + R4) / R4] + C * VTH \\ &= VREF * [(R1 + R2) / R2] + C * VTH \\ &= VINT + C * VTH \end{aligned} \tag{2}$$

As shown in equation (2), R1 is a resistance of the first resistor 2026, R2 is a resistance of the second resistor 2028, R3 is a resistance of the third resistor 2068, R4 is a resistance of the fourth resistor 2070, C is a constant, and a threshold voltage VTH is a threshold voltage of the second N-type metal-oxide-semiconductor transistor 2066. In addition, as shown in equation (2), because the first N-type metal-oxide-semiconductor transistor 2042 and the second N-type metal-oxide-semiconductor transistor 2066 have the same process structure, the tracking voltage VSDD can be varied with constant times of a threshold voltage C*VTH. For example, the tracking voltage VSDD can be varied with the constant times of the threshold voltage C*VTH under process, voltage, and temperature (PVT) variation.

As shown in FIG. 2, when a load 210 coupled to the output terminal of the low dropout regulation unit 202 needs a large transient current, the inner output voltage VINT is temporarily decreased, resulting in the voltage difference between the tracking voltage VSDD and the inner output voltage VINT is greater than the constant times of the threshold voltage C*VTH. Meanwhile, the first N-type metal-oxide-semiconductor transistor 2042 can provide the compensation current IA to the output terminal of the low dropout regulation unit 202 to increase the inner output voltage VINT. That is to say, the output terminal of the low dropout regulation unit 202 can provide an approximately fixed driving current to the load 210. When the voltage difference between the tracking voltage VSDD and the inner output voltage VINT is less than the constant times of the threshold voltage C*VTH, the self-driving unit 204 does not provide the compensation current IA to the output terminal of the low dropout regulation unit 202. In addition, when the voltage difference between the tracking voltage VSDD and the inner output voltage VINT is greater than the constant times of the threshold voltage C*VTH, because the first N-type metal-oxide-semiconductor transistor 2042 can provide the compensation current IA to the output terminal of the low dropout regulation unit 202, the low dropout regulation unit 202 has better phase margin and stability. In addition, the first P-type metal-oxide-semiconductor transistor 2024, the first N-type metal-oxide-semiconductor transistor 2042, the second P-type metal-oxide-semiconductor transistor 2064, and the second N-type metal-oxide-semiconductor transistor 2066 can be general process metal-oxide-semiconductor transistors. As shown in FIG. 2, when the first voltage V1 is greater than the tracking voltage VSDD, the second voltage V2 can be equal to the first voltage V1; and when the first voltage V1 is less than the tracking voltage VSDD, the second voltage V2 can be equal to a supply voltage provided by a charge pump. In addition, in another embodiment of the present invention, the first N-type metal-oxide-semiconductor transistor 2042 and the second N-type metal-oxide-semiconductor transistor 2066 can be replaced with an NPN-type bipolar transistor. Meanwhile, a base-emitter voltage of an NPN-type bipolar transistor can substitute for the threshold voltage VTH in equation (2).

Figure 3:
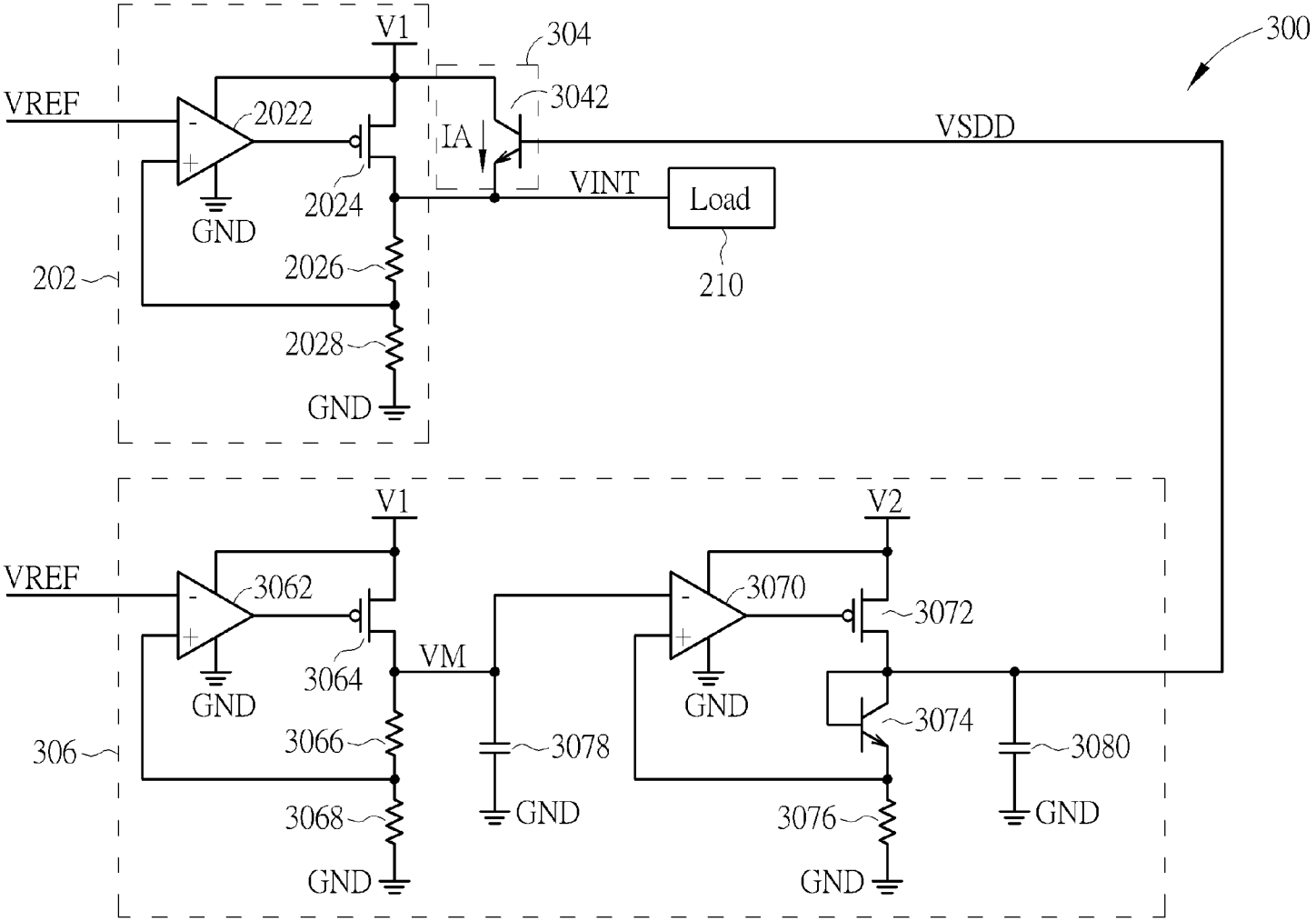
FIG. 3 is a diagram illustrating an immediate response low dropout regulation system according to another embodiment.

Please refer to FIG. 3. FIG. 3 is a diagram illustrating an immediate response low dropout regulation system 300 according to another embodiment. As shown in FIG. 3, the low dropout regulation system 300 includes a low dropout regulation unit 202, a) self-driving unit 304, and a tracking voltage generation unit 306. The tracking voltage generation unit 306 is used for generating a tracking voltage VSDD according to a reference voltage VREF. The self-driving unit 304 is coupled to the low dropout regulation unit 202 and the tracking voltage generation unit 306, where when a voltage difference between the tracking voltage VSDD and an inner output voltage VINT is greater than constant times of a base-emitter voltage, the self-driving unit 304 provides a compensation current IA to the output terminal of the low dropout regulation unit 202.

As shown in FIG. 3, the self-driving unit 304 includes a first NPN-type bipolar transistor 3042. The first NPN-type bipolar transistor 3042 has a first terminal for receiving a first voltage V1, a second terminal for receiving the tracking voltage VSDD, and a third terminal coupled to the third terminal of the first P-type metal-oxide-semiconductor transistor 2024. The tracking voltage generation unit 306 includes a second operational amplifier 3062, a second P-type metal-oxide-semiconductor transistor 3064, a third resistor 3066, a fourth resistor 3068, a third operational amplifier 3070, a third P-type metal-oxide-semiconductor transistor 3072, a second NPN-type bipolar transistor 3074, a fifth resistor 3076, a first stabilization capacitor 3078, and a second stabilization capacitor 3080. The second operational amplifier 3062 has a first terminal for receiving the first voltage V1, a second terminal coupled to ground GND, a negative input terminal for receiving a reference voltage VREF, a positive input terminal, and an output terminal. The second P-type metal-oxide-semiconductor transistor 3064 has a first terminal for receiving the first voltage V1, a second terminal coupled to the output terminal of the second operational amplifier 3062, and a third terminal for outputting an intermediate voltage VM. The third resistor 3066 has a first terminal coupled to the third terminal of the second P-type metal-oxide-semiconductor transistor 3064, and a second terminal coupled to the positive input terminal of the second operational amplifier 3062. The fourth resistor 3068 has a first terminal coupled to the second terminal of the third resistor 3066, and a second terminal coupled to the ground GND. The third operational amplifier 3070 has a first terminal for receiving a second voltage V2, a second terminal coupled to the ground GND, a negative input terminal for receiving the intermediate voltage VM, a positive input terminal, and an output terminal. The third P-type metal-oxide-semiconductor transistor 3072 has a first terminal for receiving the second voltage V2, a second terminal coupled to the output terminal of the third operational amplifier 3070, and a third terminal coupled to the second terminal of the first NPN-type bipolar transistor 3042 for outputting the tracking voltage VSDD. The second NPN-type bipolar transistor 3074 has a first terminal coupled to the third terminal of the third P-type metal-oxide-semiconductor transistor 3072, a second terminal coupled to the first terminal of the second NPN-type bipolar transistor 3074, and a third terminal coupled to the positive input terminal of the third operational amplifier 3070. The fifth resistor 3076 has a first terminal coupled to the third terminal of the second NPN-type bipolar transistor 3074, and a second terminal coupled to the ground GND. The first stabilization capacitor 3078 has a first terminal coupled to the third terminal of the second P-type metal-oxide-semiconductor transistor 3064, and a second terminal coupled to the ground GND, where the first stabilization capacitor 3078 is used for stabilizing the intermediate voltage VM. The second stabilization capacitor 3080 has a first terminal coupled to the third terminal of the third P-type metal-oxide-semiconductor transistor 3072, and a second terminal coupled to the ground GND, where the second stabilization capacitor 3080 is used for stabilizing the tracking voltage VSDD.

As shown in FIG. 3, the first NPN-type bipolar transistor 3042 and the second NPN-type bipolar transistor 3074 have the same process structure. For example, the first NPN-type bipolar transistor 3042 and the second NPN-type bipolar transistor 3074 can be vertical NPN-type bipolar transistors. But, the present invention is not limited to the first NPN-type bipolar transistor 3042 and the second NPN-type bipolar transistor 3074 being vertical NPN-type bipolar transistors. Moreover, a ratio of the first resistor 2026 to the second resistor 2028 is equal to ratio of the third resistor 3066 to the fourth resistor 3068.

As shown in FIG. 3, when the first P-type metal-oxide-semiconductor transistor 2024 operates in a saturation region, a voltage of the positive input terminal of the first operational amplifier 2022 is equal to the reference voltage VREF. Therefore, the inner output voltage VINT can be generated according to equation (1). When the second P-type metal-oxide-semiconductor transistor 3064 operates in a saturation region, a voltage of the positive input terminal of the second operational amplifier 3062 is equal to the reference voltage VREF. Therefore, the intermediate voltage VM can be generated according to equation (1), that is, the intermediate voltage VM is equal to the inner output voltage VINT. In addition, when the third P-type metal-oxide-semiconductor transistor 3072 operates in a saturation region, a voltage of the positive input terminal of the third operational amplifier 3070 is equal to the intermediate voltage VM. Therefore, the tracking voltage VSDD can be generated according to equation (1) and equation (3):

$$\begin{aligned} VSDD &= VREF * [(R3 + R4)/R4] + C * VBE \\ &= VREF * [(R1 + R2)/R2] + C * VBE \\ &= VINT + C * VBE \end{aligned} \quad (3)$$

As shown in equation (3), R1 is a resistance of the first resistor 2026, R2 is a resistance of the second resistor 2028, R3 is a resistance of the third resistor 3066, R4 is a resistance of the fourth resistor 3068, C is a constant, and a threshold voltage VBE is a base-emitter voltage of the second NPN-type bipolar transistor 3074. In addition, as shown in equation (3), because the first NPN-type bipolar transistor 3042 and the second NPN-type bipolar transistor 3074 have the same process structure, the tracking voltage VSDD can be varied with constant times of a base-emitter voltage C*VBE. For example, the tracking voltage VSDD can be varied with the constant times of the base-emitter voltage C*VBE under process, voltage, and temperature variation.

As shown in FIG. 3, when the load 210 coupled to the output terminal of the low dropout regulation unit 202 needs a large transient current, the inner output voltage VINT is temporarily decreased, resulting in the voltage difference between the tracking voltage VSDD and the inner output voltage VINT is greater than the constant times of the base-emitter voltage C*VBE. Meanwhile, the first NPN-type bipolar transistor 3042 can provide the compensation current IA to the output terminal of the low dropout regulation unit 202 to increase the inner output voltage VINT. When the voltage difference between the tracking voltage VSDD and the inner output voltage VINT is less than the constant times of the base-emitter voltage C*VBE, the self-driving unit 304 does not provide the compensation current IA to the output terminal of the low dropout regulation unit 202. In addition, As shown in FIG. 3, when the first voltage V1 is greater than the tracking voltage VSDD, the second voltage V2 can be equal to first voltage V1; and when the first voltage V1 is less than the tracking voltage VSDD, the second voltage V2 can be equal to a supply voltage provided by a charge pump. In addition, in another embodiment of the present invention, the first NPN-type bipolar transistor 3042 and the second NPN-type bipolar transistor 3074 can be replaced with an N-type metal-oxide-semiconductor transistor. Meanwhile, a threshold voltage of an N-type metal-oxide-semiconductor transistor can substitute for the base-emitter voltage VBE in equation (2). In addition, subsequent operational principles of the low dropout regulation system 300 are the same as those of the low dropout regulation system 200, so further description thereof is omitted for simplicity.

Figure 4:
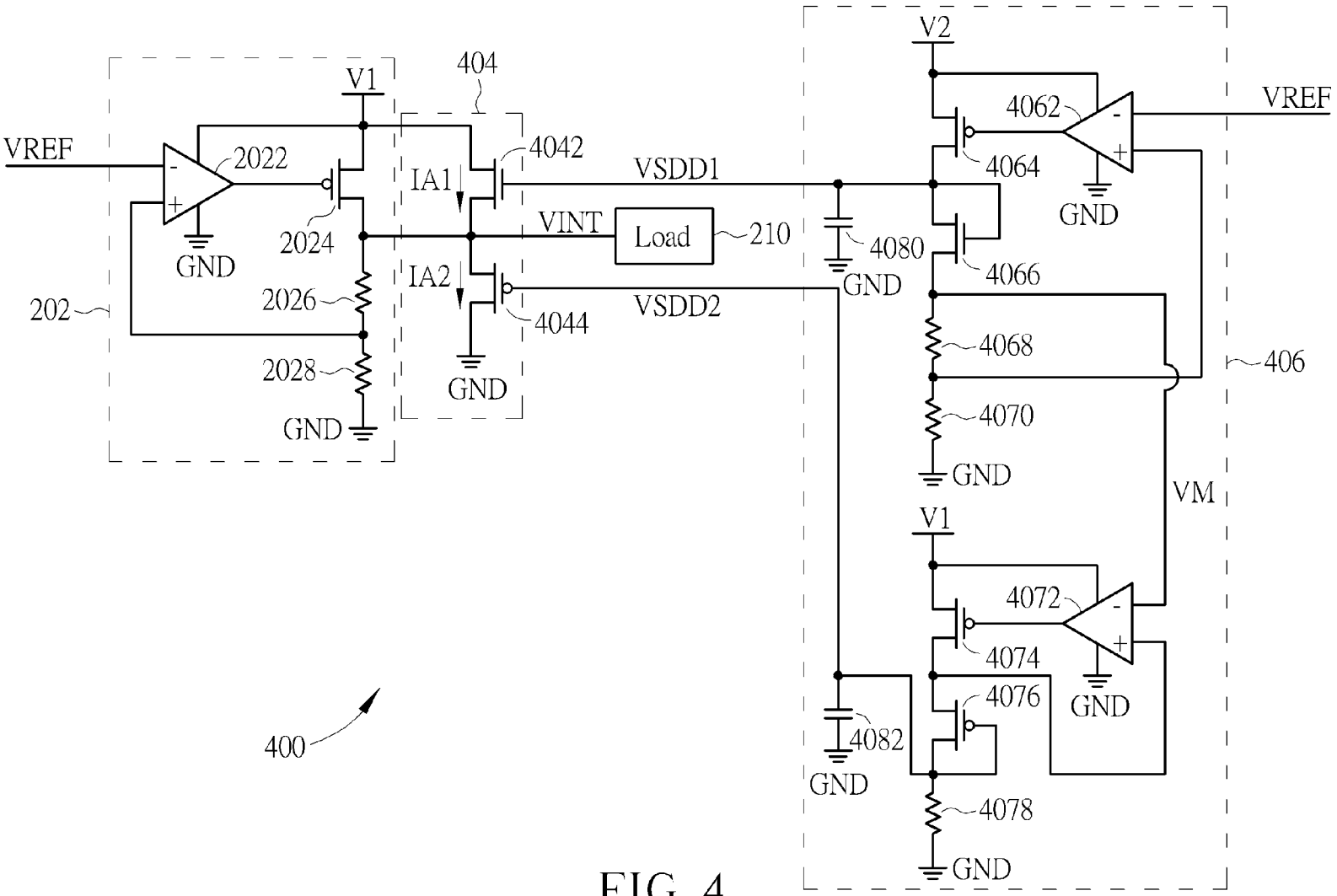
FIG. 4 is a diagram illustrating an immediate response low dropout regulation system according to another embodiment.

Please refer to FIG. 4. FIG. 4 is a diagram illustrating an immediate response low dropout regulation system 400 according to another embodiment. As shown in FIG. 4, the low dropout regulation system 400 includes a low dropout regulation unit 202, a self-driving unit 404, and a tracking voltage generation unit 406. The tracking voltage generation unit 406 is used for generating a first tracking voltage VSDD1 and a second tracking voltage VSDD2 according to a reference voltage VREF. The self-driving unit 404 is coupled to the low dropout regulation unit 202 and the tracking voltage generation unit 406, where when a voltage difference between the first tracking voltage VSDD1 and an inner output voltage VINT is greater than constant times of a first threshold voltage, the self-driving unit 404 provides a first compensation current IA1 to the output terminal of the low dropout regulation unit 202; and when a voltage difference between the inner output voltage VINT and the second tracking voltage VSSD2 is greater than constant times of a second threshold voltage, the self-driving unit 404 sinks a second compensation current IA2 from the output terminal of the low dropout regulation unit 202.

As shown in FIG. 4, the self-driving unit 404 includes a first N-type metal-oxide-semiconductor transistor 4042 and a second P-type metal-oxide-semiconductor transistor 4044. The first N-type metal-oxide-semiconductor transistor 4042 has a first terminal for receiving a first voltage V1, a second terminal for receiving the first tracking voltage VSDD1, and a third terminal coupled to the third terminal of the first P-type metal-oxide-semiconductor transistor 2024. The second P-type metal-oxide-semiconductor transistor 4044 has a first terminal coupled to the third terminal of the first N-type metal-oxide-semiconductor transistor 4042, a second terminal for receiving the second tracking voltage VSDD2, and a third terminal coupled to ground GND. The tracking voltage generation unit 406 includes a second operational amplifier 4062, a third P-type metal-oxide-semiconductor transistor 4064, a second N-type metal-oxide-semiconductor transistor 4066, a third resistor 4068, a fourth resistor 4070, a third operational amplifier 4072, a fourth P-type metal-oxide-semiconductor transistor 4074, a fifth P-type metal-oxide-semiconductor transistor 4076, a fifth resistor 4078, a first stabilization capacitor 4080, and a second stabilization capacitor 4082. The second operational amplifier 4062 has a first terminal for receiving a second voltage V2, a second terminal coupled to the ground GND, a negative input terminal for receiving the reference voltage VREF, a positive input terminal, and an output terminal. The third P-type metal-oxide-semiconductor transistor 4064 has a first terminal for receiving the second voltage V2, a second terminal coupled to the output terminal of the second operational amplifier 4062, and a third terminal coupled to the second terminal of the first N-type metal-oxide-semiconductor transistor 4042 for outputting the first tracking voltage VSDD1. The second N-type metal-oxide-semiconductor transistor 4066 has a first terminal coupled to the third terminal of the third P-type metal-oxide-semiconductor transistor 4064, a second terminal coupled to the first terminal of the second N-type metal-oxide-semiconductor transistor 4066, and a third terminal for outputting an intermediate voltage VM. The third resistor 4068 has a first terminal coupled to the third terminal of the second N-type metal-oxide-semiconductor transistor 4066, and a second terminal coupled to the positive input terminal of the second operational amplifier 4062. The fourth resistor 4070 has a first terminal coupled to the second terminal of the third resistor 4068, and a second terminal coupled to the ground GND. The third operational amplifier 4072 has a first terminal for receiving the first voltage V1, a second terminal coupled to the ground GND, a negative input terminal for receiving the intermediate voltage VM, a positive input terminal, and an output terminal. The fourth P-type metal-oxide-semiconductor transistor 4074 has a first terminal for receiving the first voltage V1, a second terminal coupled to the output terminal of the third operational amplifier 4072, and a third terminal coupled to the positive input terminal of the third operational amplifier 4072. The fifth P-type metal-oxide-semiconductor transistor 4076 has a first terminal coupled to the third terminal of the fourth P-type metal-oxide-semiconductor transistor 4074, a second terminal coupled to the second terminal of the second P-type metal-oxide-semiconductor transistor 4044, and a third terminal coupled to the second terminal of the fifth P-type metal-oxide-semiconductor transistor 4076. The fifth resistor 4078 has a first terminal coupled to the third terminal of the fifth P-type metal-oxide-semiconductor transistor 4076, and a second terminal coupled to the ground GND. The first stabilization capacitor 4080 has a first terminal coupled to the third terminal of the third P-type metal-oxide-semiconductor transistor 4064, and a second terminal coupled to the ground GND, where the first stabilization capacitor 4080 is used for stabilizing the first tracking voltage VSDD1. The second stabilization capacitor 4082 has a first terminal coupled to the third terminal of the fifth P-type metal-oxide-semiconductor transistor 4076, and a second terminal coupled to the ground GND, where the second stabilization capacitor 4082 is used for stabilizing second tracking voltage VSDD2.

As shown in FIG. 4, the first N-type metal-oxide-semiconductor transistor 4042 and the second N-type metal-oxide-semiconductor transistor 4066 have the same process structure, and the second P-type metal-oxide-semiconductor transistor 4044 and the fifth P-type metal-oxide-semiconductor transistor 4076 have the same process structure. Moreover, the ratio of the first resistor 2026 to the second resistor 2028 is equal to a ratio of the third resistor 4068 and the fourth resistor 4070.

As shown in FIG. 4, when the first P-type metal-oxide-semiconductor transistor 2024 operates in a saturation region, a voltage of the positive input terminal of the first operational amplifier 2022 is equal to the reference voltage VREF. Therefore, the inner output voltage VINT can be generated according to equation (1). When the third P-type metal-oxide-semiconductor transistor 4064 operates in a saturation region, a voltage of the positive input terminal of the second operational amplifier 4062 is equal to the reference voltage VREF. Therefore, the intermediate voltage VM can be generated according to equation (1), that is, the intermediate voltage VM is equal to the inner output voltage VINT. Then, the first tracking voltage VSDD1 can be generated according to equation (1) and equation (4):

$$\begin{aligned} VSDD1 &= VREF*[(R3+R4)/R4]+C*VTH1 \\ &= VREF*[(R1+R2)/R2]+C*VTH1 \\ &= VM+C*VTH1 \\ &= VINT+C*VTH1 \end{aligned} \tag{4}$$

As shown in equation (4), R1 is a resistance of the first resistor 2026, R2 is a resistance of the second resistor 2028, R3 is a resistance of the third resistor 4068, R4 is a resistance of the fourth resistor 4070, C is a constant, and a first threshold voltage VTH1 is a threshold voltage of the second N-type metal-oxide-semiconductor transistor 4066. In addition, as shown in equation (4), because the first N-type metal-oxide-semiconductor transistor 4042 and the second N-type metal-oxide-semiconductor transistor 4066 have the same process structure, the first tracking voltage VSDD1 can be varied with constant times of a first threshold voltage C*VTH1. For example, the first tracking voltage VSDD1 can be varied with the constant times of the first threshold voltage C*VTH1 under process, voltage, and temperature variation.

In addition, when the fourth P-type metal-oxide-semiconductor transistor 4074 operates in a saturation region, a voltage of the positive input terminal of the third operational amplifier 4072 is equal to the intermediate voltage VM. Therefore, the second tracking voltage VSDD2 can be generated according to equation (1) and equation (5):

$$\begin{aligned} VSDD2 &= VM-C*|VTH2| \\ &= VINT-C*|VTH2| \end{aligned} \tag{5}$$

As shown in equation (5), a second threshold voltage |VTH2| is equal to an absolute value of a threshold voltage of the fifth P-type metal-oxide-semiconductor transistor 4076. In addition, as shown in equation (5), because the second P-type metal-oxide-semiconductor transistor 4044 and the fifth P-type metal-oxide-semiconductor transistor 4076 have the same process structure, the second tracking voltage VSDD2 can be varied with constant times of a second threshold voltage C*|VTH2|. For example, the second tracking voltage VSDD2 can be varied with the constant times of the second threshold voltage C*|VTH2|under process, voltage, and temperature variation.

As shown in FIG. 4, when the voltage difference between the first tracking voltage VSDD1 and the inner output voltage VINT is greater than the constant times of the first threshold voltage C*VTH1, the first N-type metal-oxide-semiconductor transistor 4042 can provide the compensation current IA1 to the output terminal of the low dropout regulation unit 202; and when the voltage difference between the inner output voltage VINT and the second tracking voltage VSSD2 is greater than the constant times of the second threshold voltage C*|VTH2|, the second P-type metal-oxide-semiconductor transistor 4044 can sink the second compensation current IA2 from the output terminal of the low dropout regulation unit 202 to the ground GND. In addition, when the voltage difference between the first tracking voltage VSDD1 and the inner output voltage VINT is less than the constant times of the first threshold voltage C*VTH1, and the voltage difference between the inner output voltage VINT and the second tracking voltage VSSD2 is also less than the constant times of the second threshold voltage C*|VTH2|, the self-driving unit 404 neither provides the compensation current IA1 to the output terminal of the low dropout regulation unit 202 nor sinks the second compensation current IA2 from the output terminal of the low dropout regulation unit 202.

In addition, the P-type metal-oxide-semiconductor transistors and the N-type metal-oxide-semiconductor transistors in FIG. 4 can be general process metal-oxide-semiconductor transistors. As shown in FIG. 4, when the first voltage V1 is greater than the first tracking voltage VSDD1, the second voltage V2 can be equal to the first voltage V1; and when the first voltage V1 is less than the first tracking voltage VSDD1, the second voltage V2 can be equal to a supply voltage provided by a charge pump. In addition, in another embodiment of the present invention, the first N-type metal-oxide-semiconductor transistor 4042 and the second N-type metal-oxide-semiconductor transistor 4066 can be replaced with an NPN-type bipolar transistor, and the second P-type metal-oxide-semiconductor transistor 4044 and the fifth P-type metal-oxide-semiconductor transistor 4076 can be replaced with a PNP-type bipolar transistor. Meanwhile, a base-emitter voltage of an NPN-type bipolar transistor can substitute for the first threshold voltage VTH1 in equation (4), and a base-emitter voltage of a PNP-type bipolar transistor can substitute for the second threshold voltage |VTH2| in equation (5). In addition, subsequent operational principles of the low dropout regulation system 400 are the same as those of the low dropout regulation system 200, so further description thereof is omitted for simplicity.

Figure 5:
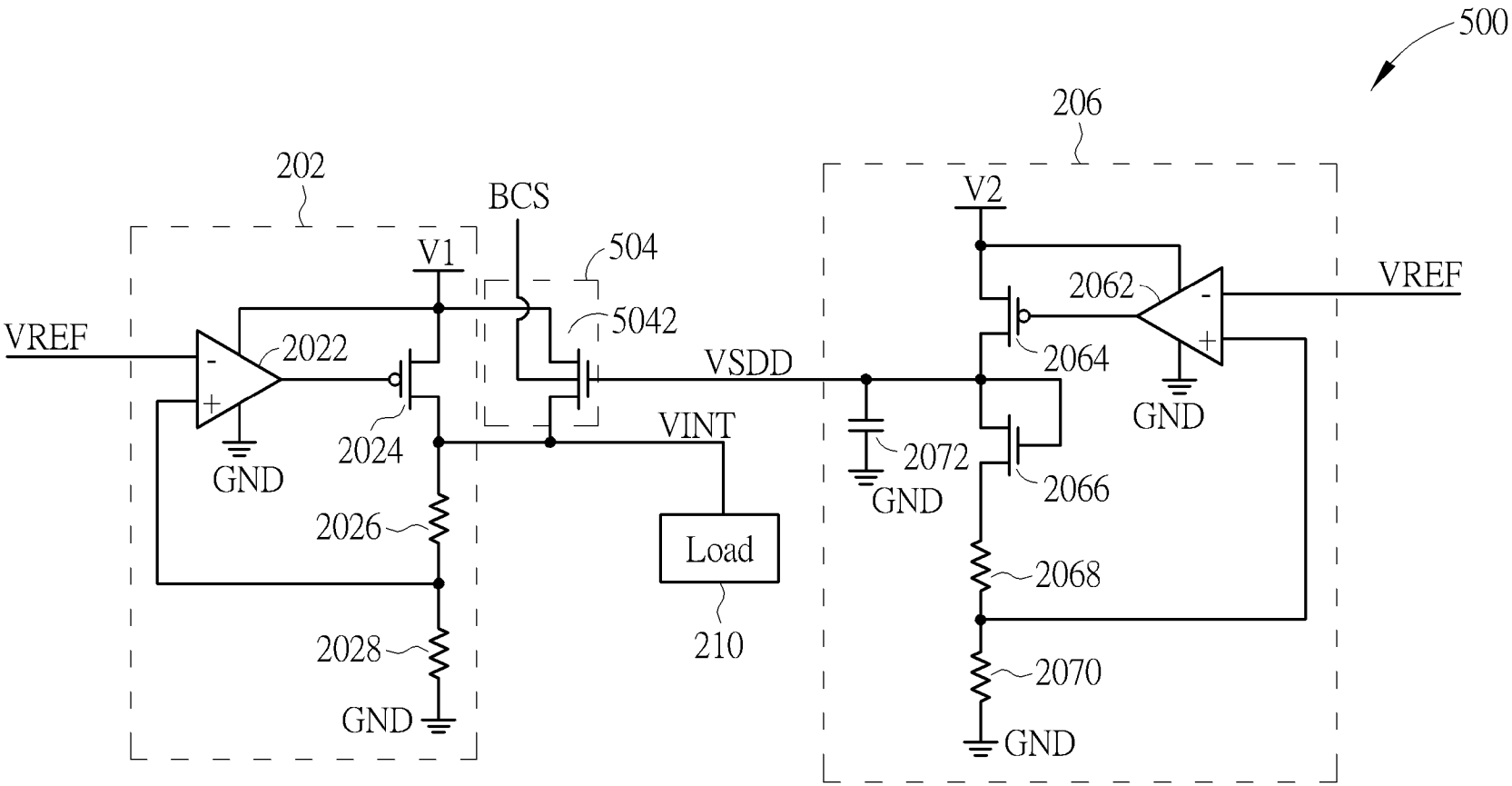
FIG. 5 is a diagram illustrating an immediate response low dropout regulation system according to another embodiment.

Please refer to FIG. 5. FIG. 5 is a diagram illustrating an immediate response low dropout regulation system 500 according to another embodiment. As shown in FIG. 5, a difference between the low dropout regulation system 500 and the low dropout regulation system 200 is that the self-driving unit 504 includes a first N-type metal-oxide-semiconductor transistor 5042. The first N-type metal-oxide-semiconductor transistor 5042 has a first terminal for receiving a first voltage V1, a second terminal for receiving a tracking voltage VSDD, a third terminal coupled to the third terminal of the first P-type metal-oxide-semiconductor transistor 2024, and a body for receiving a body control signal BCS, where when the low dropout regulation system 500 is in an active mode (for example, the load 210 coupled to the output terminal of the low dropout regulation unit 202 needs a large transient current), the body control signal BCS is between an inner output voltage VINT and a zero voltage. Therefore, when the low dropout regulation system 500 is in the active mode, because the body control signal BCS is between the inner output voltage VINT and the zero voltage, the self-driving unit 504 can immediately provide a compensation current IA to the output terminal of the low dropout regulation unit 202. When the low dropout regulation system 500 is in a standby mode (for example, the load 210 coupled to the output terminal of the low dropout regulation unit 202 does not need a large transient current), the body control signal BCS is equal to the zero voltage. Therefore, when the low dropout regulation system 500 is in the standby mode, because the body control signal BCS is equal to the zero voltage, body effect of the first N-type metal-oxide-semiconductor transistor 5042 is very serious, resulting in the self-driving unit 504 not easily providing the compensation current IA to the output terminal of the low dropout regulation unit 202. Thus, when the low dropout regulation system 500 is in the standby mode, because the self-driving unit 504 can not completely provide the compensation current IA to the output terminal of the low dropout regulation unit 202, the low dropout regulation unit 202 can regulate the inner output voltage VINT more easily.

In another embodiment of the present invention, the first N-type metal-oxide-semiconductor transistor 5042 has a first terminal for receiving a first voltage V1, a second terminal for receiving a tracking voltage VSDD, and a third terminal coupled to the third terminal of the first P-type metal-oxide-semiconductor transistor 2024, where when the low dropout regulation system 500 is in the active mode, a voltage difference between the tracking voltage VSDD and the inner output voltage VINT is greater than a threshold voltage of the first N-type metal-oxide-semiconductor transistor 5042. Therefore, when the low dropout regulation system 500 is in the active mode, because the voltage difference between the tracking voltage VSDD and the inner output voltage VINT is greater than the threshold voltage of the first N-type metal-oxide-semiconductor transistor 5042, the self-driving unit 504 can immediately provide a compensation current IA to the output terminal of the low dropout regulation unit 202; and when the low dropout regulation system 500 is in the standby mode, the voltage difference between the tracking voltage VSDD and the inner output voltage VINT is less than the threshold voltage of the first N-type metal-oxide-semiconductor transistor 5042. Therefore, when the low dropout regulation system 500 is in the standby mode, because the voltage difference between the tracking voltage VSDD and the inner output voltage VINT is less than the threshold voltage of the first N-type metal-oxide-semiconductor transistor 5042, the first N-type metal-oxide-semiconductor transistor 5042 is turned off, resulting in the self-driving unit 504 not providing the compensation current IA to the output terminal of the low dropout regulation unit 202. Thus, when the low dropout regulation system 500 is in the standby mode, because the self-driving unit 504 can not provide the compensation current IA to the output terminal of the low dropout regulation unit 202, the low dropout regulation unit 202 can regulate the inner output voltage VINT more easily. In addition, in another embodiment of the present invention, the self-driving unit 504 further includes a first switch coupled between the first terminal of the first N-type metal-oxide-semiconductor transistor 5042 and the first terminal of the first P-type metal-oxide-semiconductor transistor 2024, when the low dropout regulation system 500 is in the active mode, the first switch is turned on, so the self-driving unit 504 can provide the compensation current IA to the output terminal of the low dropout regulation unit 202; and when the low dropout regulation system 500 is in the standby mode, the first switch is turned off, so the self-driving unit 504 can not provide the compensation current IA to the output terminal of the low dropout regulation unit 202. In addition, in another embodiment of the present invention, the self-driving unit 504 further includes a second switch coupled between the third terminal of the first N-type metal-oxide-semiconductor transistor 5042 and the third terminal of the first P-type metal-oxide-semiconductor transistor 2024, where operational principles of the second switch are the same as those of the first switch, so further description thereof is omitted for simplicity.

Figure 6:
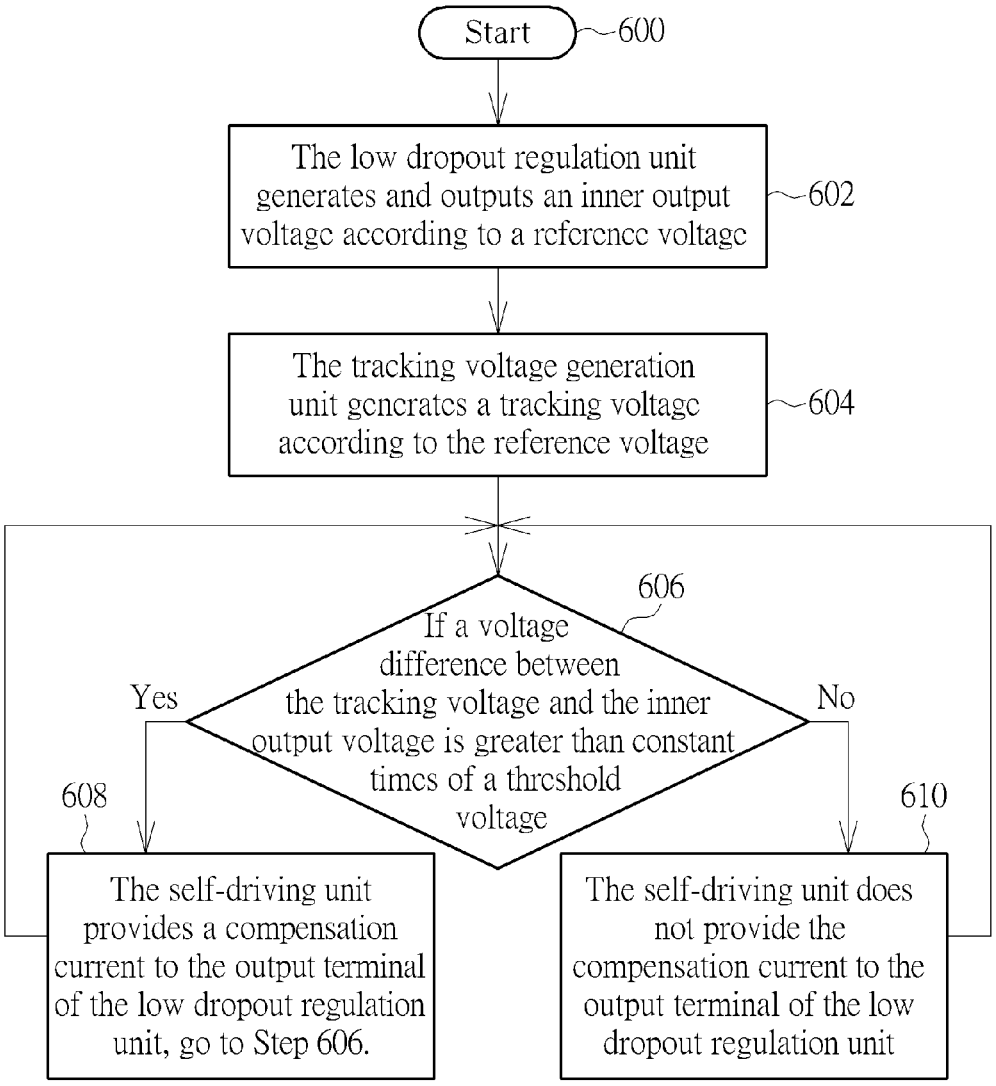
FIG. 6 is an operation method of a low dropout regulation system according to another embodiment.

Please refer to FIG. 2, FIG. 3, and FIG. 6. FIG. 6 is an operation method of a low dropout regulation system according to another embodiment. The method in FIG. 6 is illustrated using the low dropout regulation system 200 in FIG. 2 and the low dropout regulation system 300 in FIG. 3. Detailed steps are as follows:

Step 600: Start.

Step 602: The low dropout regulation unit 202 generates and outputs an inner output voltage VINT according to a reference voltage VREF.

Step 604: The tracking voltage generation unit 206 generates a tracking voltage VSDD according to the reference voltage VREF.

Step 606: If a voltage difference between the tracking voltage VSDD and the inner output voltage VINT is greater than constant times of a threshold voltage; if yes, go to Step 608; if no, go to Step 610.

Step 608: The self-driving unit 204 provides a compensation current IA to the output terminal of the low dropout regulation unit, go to Step 606.

Step 610: The self-driving unit 204 does not provide the compensation current IA to the output terminal of the low dropout regulation unit, go to Step 606.

Take the low dropout regulation system 200 in FIG. 2 as an example. In Step 602, when the first P-type metal-oxide-semiconductor transistor 2024 operates in a saturation region, the low dropout regulation unit 202 can generate and output the inner output voltage VINT according to the reference voltage VREF and equation (1). In Step 604, when the second P-type metal-oxide-semiconductor transistor 2064 operates in a saturation region, the tracking voltage generation unit 206 can generate the tracking voltage VSDD according to the reference voltage VREF, equation (1), and equation (2). In Step 608, when the load 210 coupled to the output terminal of the low dropout regulation unit 202 needs a large transient current, the inner output voltage VINT is temporarily decreased, resulting in a voltage difference between the tracking voltage VSDD and the inner output voltage VINT is greater than the constant times threshold voltage C*VTH. Therefore, the first N-type metal-oxide-semiconductor transistor 2042 of the self-driving unit 204 can provide the compensation current IA to the output terminal of the low dropout regulation unit 202 to increase the inner output voltage VINT. That is to say, the output terminal of the low dropout regulation unit 202 can provide an approximately fixed driving current to the load 210. In Step 610, when the voltage difference between the tracking voltage VSDD and the inner output voltage VINT is less than the constant times threshold voltage C*VTH, the self-driving unit 204 does not provide the compensation current IA to the output terminal of the low dropout regulation unit 202.

Take the low dropout regulation system 200 in FIG. 2 as an example. In Step 602, when the first P-type metal-oxide-semiconductor transistor 2024 operates in a saturation region, the low dropout regulation unit 202 can generate and output the inner output voltage VINT according to the reference voltage VREF and equation (1). In Step 604, when the second P-type metal-oxide-semiconductor transistor 2064 operates in a saturation region, the tracking voltage generation unit 206 can generate the tracking voltage VSDD according to the reference voltage VREF, equation (1), and equation (2). In Step 608, when the load 210 coupled to the output terminal of the low dropout regulation unit 202 needs a large transient current, the inner output voltage VINT is temporarily decreased, resulting in a voltage difference between the tracking voltage VSDD and the inner output voltage VINT is greater than the constant times of the threshold voltage C*VTH. Therefore, the first N-type metal-oxide-semiconductor transistor 2042 of the self-driving unit 204 can provide the compensation current IA to the output terminal of the low dropout regulation unit 202 to increase the inner output voltage VINT. That is to say, the output terminal of the low dropout regulation unit 202 can provide an approximately fixed driving current to the load 210. In Step 610, when the voltage difference between the tracking voltage VSDD and the inner output voltage VINT is less than the constant times of the threshold voltage C*VTH, the self-driving unit 204 does not provide the compensation current IA to the output terminal of the low dropout regulation unit 202.

Take the low dropout regulation system 300 in FIG. 3 as an example. In Step 602, when the first P-type metal-oxide-semiconductor transistor 2024 operates in a saturation region, the low dropout regulation unit 202 can generate and output the inner output voltage VINT according to the reference voltage VREF and equation (1). In Step 604, when the second P-type metal-oxide-semiconductor transistor 3064 operates in a saturation region, the tracking voltage generation unit 306 can generate and output intermediate voltage VM (equal to the inner output voltage VINT) according to the reference voltage VREF and equation (1). Then, the tracking voltage generation unit 306 generates the tracking voltage VSDD according to the intermediate voltage VM, equation (1), and equation (3). In Step 608, when the load 210 coupled to the output terminal of the low dropout regulation unit 202 needs a large transient current, the inner output voltage VINT is temporarily decreased, resulting in a voltage difference between the tracking voltage VSDD and the inner output voltage VINT is greater than the constant times of the base-emitter voltage C*VBE. Therefore, the first NPN-type bipolar transistor 3042 of the self-driving unit 304 can provide the compensation current IA to the output terminal of the low dropout regulation unit 202 to increase the inner output voltage VINT. In Step 610, when the voltage difference between the tracking voltage VSDD and the inner output voltage VINT is less than the constant times of the base-emitter voltage C*VBE, the self-driving unit 304 does not provide the compensation current IA to the output terminal of the low dropout regulation unit 202.

Figure 7:
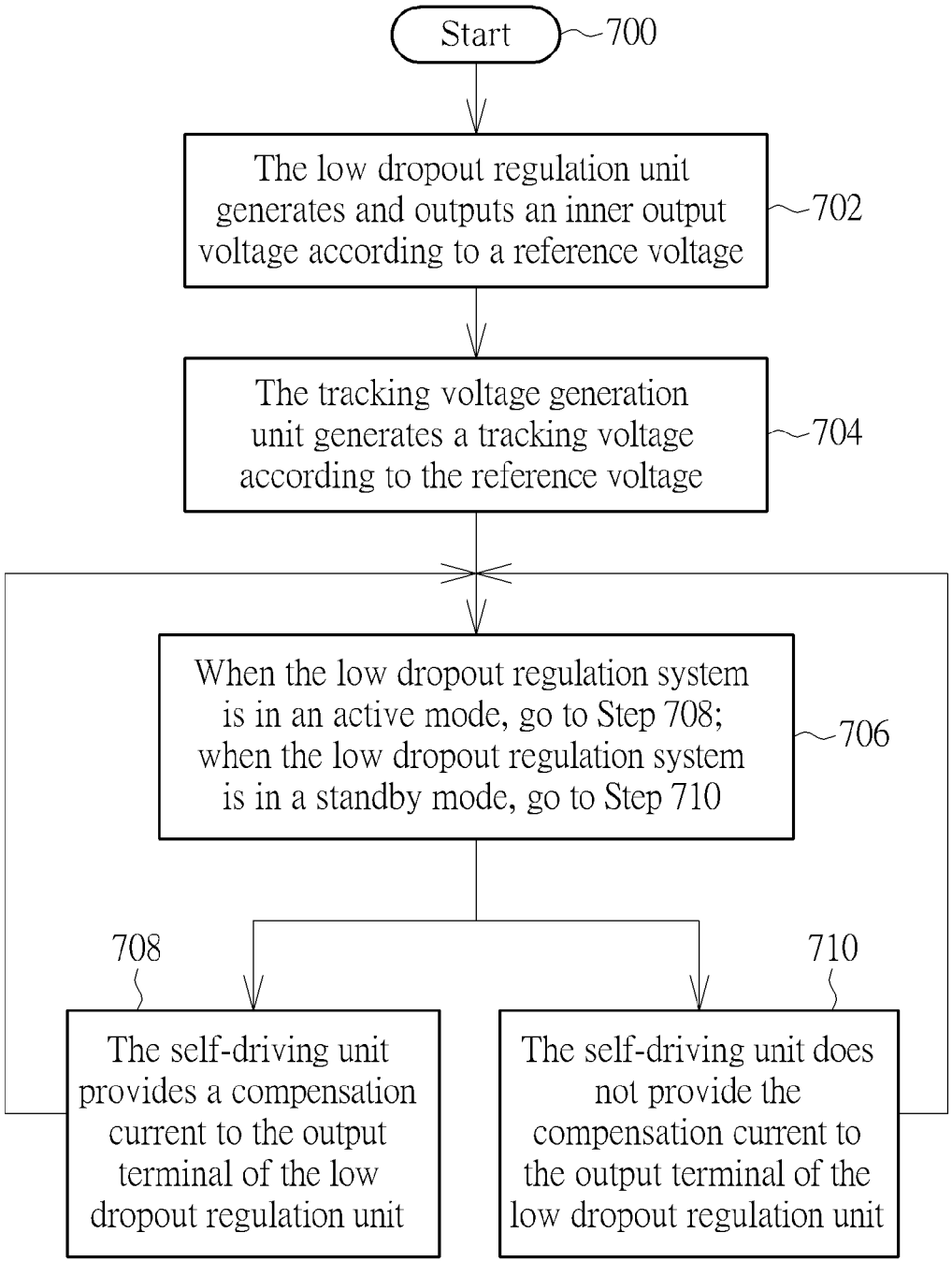
FIG. 7 is an operation method of a low dropout regulation system according to another embodiment.

Please refer to FIG. 5 and FIG. 7. FIG. 7 is an operation method of a low dropout regulation system according to another embodiment. The method in FIG. 7 is illustrated using the low dropout regulation system 500 in FIG. 5. Detailed steps are as follows:

Step 700: Start.

Step 702: The low dropout regulation unit 202 generates and outputs an inner output voltage VINT according to a reference voltage VREF.

Step 704: The tracking voltage generation unit 206 generates a tracking voltage VSDD according to the reference voltage VREF.

Step 706: When the low dropout regulation system 500 is in an active mode, go to Step 708; when the low dropout regulation system 500 is in a standby mode, go to Step 710.

Step 708: The self-driving unit 504 provides a compensation current IA to the output terminal of the low dropout regulation unit 202, go to Step 706.

Step 710: The self-driving unit 504 does not provide the compensation current IA to the output terminal of the low dropout regulation unit 202, go to Step 706.

A difference between the embodiment in FIG. 7 and the embodiment in FIG. 6 is that in Step 706, when the low dropout regulation system 500 is in the active mode (for example, the load 210 coupled to the output terminal of the low dropout regulation unit 202 needs a large transient current), a body control signal BCS is between the inner output voltage VINT and a zero voltage. Therefore, in Step 708, when the low dropout regulation system 500 is in the active mode, because the body control signal BCS is between the inner output voltage VINT and the zero voltage, the self-driving unit 504 can provide the compensation current IA to the output terminal of the low dropout regulation unit 202. In addition, in Step 706, when the low dropout regulation system 500 is in the standby mode (for example, the load 210 coupled to the output terminal of the low dropout regulation unit 202 does not need the large transient current), the body control signal BCS is equal to the zero voltage. Therefore, in Step 710, when the low dropout regulation system 500 is in the standby mode, because the body control signal BCS is equal to the zero voltage, body effect of the first N-type metal-oxide-semiconductor transistor 5042 is very serious, resulting in the self-driving unit 504 not easily providing the compensation current IA to the output terminal of the low dropout regulation unit 202. In addition, subsequent operational principles of the embodiment in FIG. 7 are the same as those of the embodiment in FIG. 6, so further description thereof is omitted for simplicity. In addition, in another embodiment of the present invention, when the low dropout regulation system 500 is in the active mode, a voltage difference between the tracking voltage VSDD and the inner output voltage VINT is greater than a threshold voltage of the first N-type metal-oxide-semiconductor transistor 5042. Therefore, when the low dropout regulation system 500 is in the active mode, because the voltage difference between the tracking voltage VSDD and the inner output voltage VINT is greater than the threshold voltage of the first N-type metal-oxide-semiconductor transistor 5042, the self-driving unit 504 can provide the compensation current IA to the output terminal of the low dropout regulation unit 202. When the low dropout regulation system 500 is in the standby mode, the voltage difference between the tracking voltage VSDD and the inner output voltage VINT is less than the threshold voltage of the first N-type metal-oxide-semiconductor transistor 5042. Therefore, when the low dropout regulation system 500 is in the standby mode, because the voltage difference between the tracking voltage VSDD and the inner output voltage VINT is less than the threshold voltage of the first N-type metal-oxide-semiconductor transistor 5042, the first N-type metal-oxide-semiconductor transistor 5042 is turned off, resulting in self-driving unit 504 not providing the compensation current IA to the output terminal of the low dropout regulation unit 202. In addition, in another embodiment of the present invention, the self-driving unit 504 further includes a first switch coupled between the first terminal of the first N-type metal-oxide-semiconductor transistor 5042 and the first terminal of the first P-type metal-oxide-semiconductor transistor 2024. When the low dropout regulation system 500 is in the active mode, the first switch is turned on, the self-driving unit 504 can provide the compensation current IA to the output terminal of the low dropout regulation unit 202. When the low dropout regulation system 500 is in the standby mode, the first switch is turned off, so the self-driving unit 504 can not provide the compensation current IA to the output terminal of the low dropout regulation unit 202. In addition, in another embodiment of the present invention, the self-driving unit 504 further includes a second switch coupled between the third terminal of the first N-type metal-oxide-semiconductor transistor 5042 and the third terminal of the first P-type metal-oxide-semiconductor transistor 2024, where operational principles of the second switch are the same as those of the first switch, so further description thereof is omitted for simplicity.

Figure 8:
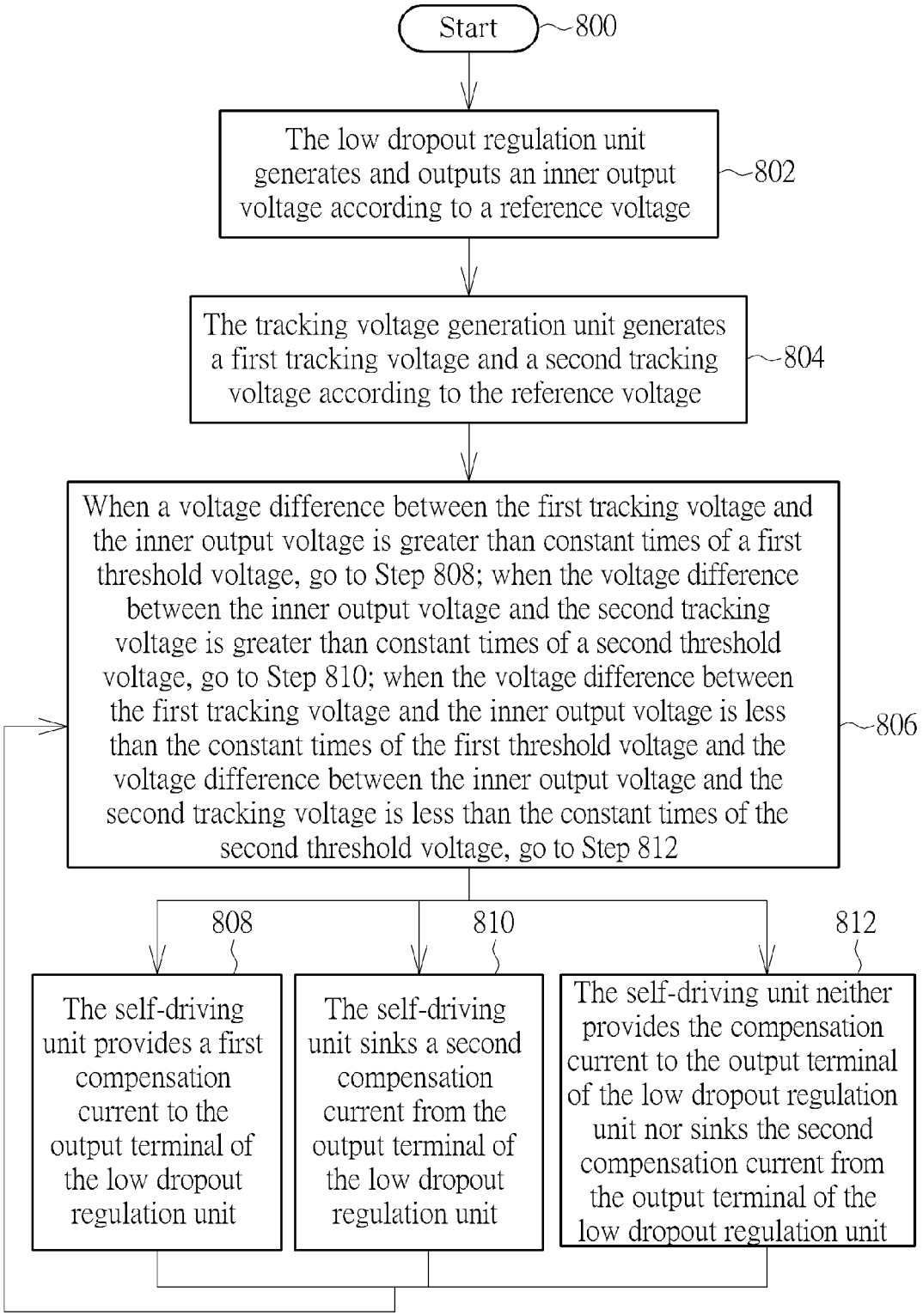
FIG. 8 is an operation method of a low dropout regulation system according to another embodiment.

Please refer to FIG. 4 and FIG. 8. FIG. 8 is an operation method of a low dropout regulation system according to another embodiment. The method in FIG. 8 is illustrated using the low dropout regulation system 400 in FIG. 4. Detailed steps are as follows:

Step 800: Start.

Step 802: The low dropout regulation unit 202 generates and outputs an inner output voltage VINT according to a reference voltage VREF.

Step 804: The tracking voltage generation unit 406 generates a first tracking voltage VSSD1 and a second tracking voltage VSSD2 according to the reference voltage VREF.

Step 806: When a voltage difference between the first tracking voltage VSSD1 and the inner output voltage VINT is greater than constant times of a first threshold voltage C*VTH1, go to Step 808; when the voltage difference between the inner output voltage VINT and the second tracking voltage VSSD2 is greater than constant times of a second threshold voltage C*|VTH2|, go to Step 810; when the voltage difference between the first tracking voltage VSSD1 and the inner output voltage VINT is less than the constant times of the first threshold voltage C*VTH1 and the voltage difference between the inner output voltage VINT and the second tracking voltage VSSD2 is less than the constant times of the second threshold voltage C*|VTH2|, go to Step 812.

Step 808: The self-driving unit 404 provides a first compensation current IA1 to the output terminal of the low dropout regulation unit 202, go to Step 806.

Step 810: The self-driving unit 404 sinks a second compensation current IA2 from the output terminal of the low dropout regulation unit 202, go to Step 806.

Step 812: The self-driving unit 404 neither provides the compensation current IA1 to the output terminal of the low dropout regulation unit 202 nor sinks the second compensation current IA2 from the output terminal of the low dropout regulation unit 202, go to Step 806.

In Step 804, when the third P-type metal-oxide-semiconductor transistor 4064 operates in a saturation region, the tracking voltage generation unit 406 can generate and output an intermediate voltage VM (equal to the inner output voltage VINT) according to the reference voltage VREF and equation (1). Therefore, the first tracking voltage VSDD1 can be generated according to the intermediate voltage VM and equation (4). In addition, when the fourth P-type metal-oxide-semiconductor transistor 4074 operates in a saturation region, a voltage of the positive input terminal of the third operational amplifier 4072 is equal to the intermediate voltage VM. Therefore, the second tracking voltage VSDD2 can be generated according to the intermediate voltage VM and equation (5). In Step 808, when the voltage difference between the first tracking voltage VSDD1 and the inner output voltage VINT is greater than the constant times of the first threshold voltage C*VTH1, the first N-type metal-oxide-semiconductor transistor 4042 of the self-driving unit 404 can provide the compensation current IA1 to the output terminal of the low dropout regulation unit 202. In Step 810, when the voltage difference between the inner output voltage VINT and the second tracking voltage VSSD2 is greater than the constant times of the second threshold voltage C*|VTH2|, the second P-type metal-oxide-semiconductor transistor 4044 of the self-driving unit 404 can sink the second compensation current IA2 from the output terminal of the low dropout regulation unit 202 to the ground GND. In Step 812, when the voltage difference between the first tracking voltage VSDD1 and the inner output voltage VINT is less than the constant times of the first threshold voltage C*VTH1, and the voltage difference between the inner output voltage VINT and the second tracking voltage VSSD2 is less than the constant times of the second threshold voltage C*|VTH2|, the self-driving unit 404 neither provides the compensation current IA1 to the output terminal of the low dropout regulation unit 202 nor sinks the second compensation current IA2 from the output terminal of the low dropout regulation unit 202.

To sum up, the immediate response low dropout regulation system and the operation method of a low dropout regulation system utilize the tracking voltage generation unit to generate a tracking voltage, or a first tracking voltage and a second tracking voltage. Then, the self-driving unit can generate a compensation current to regulate the inner output voltage according to the inner output voltage and the tracking voltage, or according to the inner output voltage, the first tracking voltage, and the second tracking voltage. Therefore, the present invention has advantages as follows: first, when the load coupled to the low dropout regulation unit needs a large transient current, the self-driving unit can immediately provide the compensation current to the output terminal of the low dropout regulation unit to regulate the inner output voltage; second, because the self-driving unit can immediate respond to variation of the inner output voltage, the present invention does not need an additional feedback mechanism; third, because the self-driving unit can immediate provide the compensation current to the output terminal of the low dropout regulation unit, the low dropout regulation unit can provide a stable driving current to the load; fourth, because the self-driving unit can immediate provide the compensation current to the output terminal of the low dropout regulation unit, the low dropout regulation unit has better phase margin and stability; and fifth, the present invention does not need special process metal-oxide-semiconductor transistors.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An immediate response low dropout regulation system, comprising:

a low dropout regulation unit for generating and outputting an inner output voltage according to a reference voltage;

a tracking voltage generation unit for generating a tracking voltage according to the reference voltage, wherein a voltage difference between the tracking voltage and the inner output voltage is in positive correlation with constant times of a threshold voltage of a transistor within in the tracking voltage generation unit and is independent of the reference voltage; and a self-driving unit coupled to the low dropout regulation unit and the tracking voltage generation unit, wherein when the voltage difference between the tracking voltage and the inner output voltage is greater than the constant times of the threshold voltage, the self-driving unit provides a compensation current to an output terminal of the low dropout regulation unit.

2. The low dropout regulation system of claim 1, wherein the low dropout regulation unit comprises:

a first operational amplifier having a first terminal for receiving a first voltage, a second terminal coupled to ground, a negative input terminal for receiving the reference voltage, a positive input terminal, and an output terminal;

a first P-type metal-oxide-semiconductor transistor having a first terminal for receiving the first voltage, a second terminal coupled to the output terminal of the first operational amplifier, and a third terminal for outputting the inner output voltage;

a first resistor having a first terminal coupled to the third terminal of the first P-type metal-oxide-semiconductor transistor, and a second terminal coupled to the positive input terminal of the first operational amplifier; and a second resistor having a first terminal coupled to the second terminal of the first resistor, and a second terminal coupled to the ground.

3. The low dropout regulation system of claim 2, wherein the self-driving unit comprises:

a first N-type metal-oxide-semiconductor transistor having a first terminal for receiving the first voltage, a second terminal for receiving the tracking voltage, and a third terminal coupled to the third terminal of the first P-type metal-oxide-semiconductor transistor.

4. The low dropout regulation system of claim 3, wherein the first N-type metal-oxide-semiconductor transistor further comprises:

a body for receiving a body control signal.

5. The low dropout regulation system of claim 4, wherein when the low dropout regulation system is in an active mode, the body control signal is between the inner output voltage and a zero voltage; when the low dropout regulation system is in a standby mode, the body control signal is equal to the zero voltage.

6. The low dropout regulation system of claim 3, wherein the tracking voltage generation unit comprises:

a second operational amplifier having a first terminal for receiving a second voltage, a second terminal coupled to the ground, a negative input terminal for receiving the reference voltage, a positive input terminal, and an output terminal;

a second P-type metal-oxide-semiconductor transistor having a first terminal for receiving the second voltage, a second terminal coupled to the output terminal of the second operational amplifier, and a third terminal coupled to the second terminal of the first N-type metal-oxide-semiconductor transistor for outputting the tracking voltage;

a second N-type metal-oxide-semiconductor transistor having a first terminal coupled to the third terminal of the second P-type metal-oxide-semiconductor transistor, a second terminal coupled to the first terminal of the second N-type metal-oxide-semiconductor transistor, and a third terminal;

a third resistor having a first terminal coupled to the third terminal of the second N-type metal-oxide-semiconductor transistor, and a second terminal coupled to the positive input terminal of the second operational amplifier; and a fourth resistor having a first terminal coupled to the second terminal of the third resistor, and a second terminal coupled to the ground.

7. The low dropout regulation system of claim 6, wherein the first N-type metal-oxide-semiconductor transistor and the second N-type metal-oxide-semiconductor transistor have the same process structure.

8. The low dropout regulation system of claim 6, wherein the tracking voltage generation unit further comprises:

a stabilization capacitor having a first terminal coupled to the third terminal of the second P-type metal-oxide-semiconductor transistor, and a second terminal coupled to the ground, wherein the stabilization capacitor is used for stabilizing the tracking voltage.

9. The low dropout regulation system of claim 6, wherein the threshold voltage is equal to a threshold voltage of the second N-type metal-oxide-semiconductor transistor.

10. The low dropout regulation system of claim 6, wherein a ratio of the first resistor to the second resistor is equal to a ratio of the third resistor to the fourth resistor.

11. The low dropout regulation system of claim 6, wherein when the first voltage is greater than the tracking voltage, the second voltage is equal to the first voltage.

12. The low dropout regulation system of claim 6, wherein when the first voltage is less than the tracking voltage, the second voltage is equal to a supply voltage provided by a charge pump.

13. The low dropout regulation system of claim 2, wherein the self-driving unit comprises:

a first NPN-type bipolar transistor having a first terminal for receiving the first voltage, a second terminal for receiving the tracking voltage, and a third terminal coupled to the third terminal of the first P-type metal-oxide-semiconductor transistor.

14. The low dropout regulation system of claim 13, wherein the tracking voltage generation unit comprises:

a second operational amplifier having a first terminal for receiving the first voltage, a second terminal coupled to the ground, a negative input terminal for receiving the reference voltage, a positive input terminal, and an output terminal;

a second P-type metal-oxide-semiconductor transistor having a first terminal for receiving the first voltage, a second terminal coupled to the output terminal of the second operational amplifier, and a third terminal for outputting an intermediate voltage;

a third resistor having a first terminal coupled to the third terminal of the second P-type metal-oxide-semiconductor transistor, and a second terminal coupled to the positive input terminal of the second operational amplifier;

a fourth resistor having a first terminal coupled to the second terminal of the third resistor, and a second terminal coupled to the ground;

a third operational amplifier having a first terminal for receiving a second voltage, a second terminal coupled to the ground, a negative input terminal for receiving the intermediate voltage, a positive input terminal, and an output terminal;

a third P-type metal-oxide-semiconductor transistor having a first terminal for receiving the second voltage, a second terminal coupled to the output terminal of the third operational amplifier, and a third terminal coupled to the second terminal of the first NPN-type bipolar transistor for outputting the tracking voltage;

a second NPN-type bipolar transistor having a first terminal coupled to the third terminal of the third P-type metal-oxide-semiconductor transistor, a second terminal coupled to the first terminal of the second NPN-type bipolar transistor, and a third terminal coupled to the positive input terminal of the third operational amplifier; and a fifth resistor having a first terminal coupled to the third terminal of the second NPN-type bipolar transistor, and a second terminal coupled to the ground.

15. The low dropout regulation system of claim 14, wherein the first NPN-type bipolar transistor and the second NPN-type bipolar transistor have the same process structure.

16. The low dropout regulation system of claim 14, wherein the tracking voltage generation unit further comprises:

a first stabilization capacitor having a first terminal coupled to the third terminal of the second P-type metal-oxide-semiconductor transistor, and a second terminal coupled to the ground, wherein the first stabilization capacitor is used for stabilizing the intermediate voltage; and a second stabilization capacitor having a first terminal coupled to the third terminal of the third P-type metal-oxide-semiconductor transistor, and a second terminal coupled to the ground, wherein the second stabilization capacitor is used for stabilizing the tracking voltage.

17. The low dropout regulation system of claim 14, wherein the threshold voltage is equal to a base-emitter voltage of the second NPN-type bipolar transistor.

18. The low dropout regulation system of claim 14, wherein a ratio of the first resistor to the second resistor is equal to a ratio of the third resistor to the fourth resistor.

19. The low dropout regulation system of claim 14, wherein when the first voltage is greater than the tracking voltage, the second voltage is equal to the first voltage.

20. The low dropout regulation system of claim 14, wherein when the first voltage is less than the tracking voltage, the second voltage is equal to a supply voltage provided by a charge pump.

21. An immediate response low dropout regulation system, comprising:

a low dropout regulation unit for generating and outputting an inner output voltage according to a reference voltage;

a tracking voltage generation unit for generating a first tracking voltage and a second tracking voltage according to the reference voltage, wherein a voltage difference between the first tracking voltage and the inner output voltage is in positive correlation with constant times of a first threshold voltage of a first transistor within in the tracking voltage generation unit and is independent of the reference voltage, and a voltage difference between the second tracking voltage and the inner output voltage is in positive correlation with constant times of a second threshold voltage of a second transistor within in the tracking voltage generation unit and is independent of the reference voltage; and a self-driving unit coupled to the low dropout regulation unit and the tracking voltage generation unit, wherein when the voltage difference between the first tracking voltage and the inner output voltage is greater than the constant times of the first threshold voltage, the self-driving unit provides a first compensation current to the output terminal of the low dropout regulation unit; and when the voltage difference between the inner output voltage and the second tracking voltage is greater than the constant times of the second threshold voltage, the self-driving unit sinks a second compensation current from the output terminal of the low dropout regulation unit.

22. The low dropout regulation system of claim 21, wherein the low dropout regulation unit comprises:

a first operational amplifier having a first terminal for receiving a first voltage, a second terminal coupled to ground, a negative input terminal for receiving the reference voltage, a positive input terminal, and an output terminal;

a first P-type metal-oxide-semiconductor transistor having a first terminal for receiving the first voltage, a second terminal coupled to the output terminal of the first operational amplifier, and a third terminal for outputting the inner output voltage;

a first resistor having a first terminal coupled to the third terminal of the first P-type metal-oxide-semiconductor transistor, and a second terminal coupled to the positive input terminal of the first operational amplifier; and a second resistor having a first terminal coupled to the second terminal of the first resistor, and a second terminal coupled to the ground.

23. The low dropout regulation system of claim 22, wherein the self-driving unit comprises:

a first N-type metal-oxide-semiconductor transistor having a first terminal for receiving the first voltage, a second terminal for receiving the first tracking voltage, and a third terminal coupled to the third terminal of the first P-type metal-oxide-semiconductor transistor; and a second P-type metal-oxide-semiconductor transistor having a first terminal coupled to the third terminal of the first N-type metal-oxide-semiconductor transistor, a second terminal for receiving the second tracking voltage, and a third terminal coupled to the ground.

24. The low dropout regulation system of claim 23, wherein the tracking voltage generation unit comprises:

a second operational amplifier having a first terminal for receiving a second voltage, a second terminal coupled to the ground, a negative input terminal for receiving the reference voltage, a positive input terminal, and an output terminal;

a third P-type metal-oxide-semiconductor transistor having a first terminal for receiving the second voltage, a second terminal coupled to the output terminal of the second operational amplifier, and a third terminal coupled to the second terminal of the first N-type metal-oxide-semiconductor transistor for outputting the first tracking voltage;

a second N-type metal-oxide-semiconductor transistor having a first terminal coupled to the third terminal of the third P-type metal-oxide-semiconductor transistor, a second terminal coupled to the first terminal of the second N-type metal-oxide-semiconductor transistor, and a third terminal for outputting an intermediate voltage;

a third resistor having a first terminal coupled to the third terminal of the second N-type metal-oxide-semiconductor transistor, and a second terminal coupled to the positive input terminal of the second operational amplifier;

a fourth resistor having a first terminal coupled to the second terminal of the third resistor, and a second terminal coupled to the ground;

a third operational amplifier having a first terminal for receiving the first voltage, a second terminal coupled to the ground, a negative input terminal for receiving the intermediate voltage, a positive input terminal, and an output terminal;

a fourth P-type metal-oxide-semiconductor transistor having a first terminal for receiving the first voltage, a second terminal coupled to the output terminal of the third operational amplifier, and a third terminal coupled to the positive input terminal of the third operational amplifier;

a fifth P-type metal-oxide-semiconductor transistor having a first terminal coupled to the third terminal of the fourth P-type metal-oxide-semiconductor transistor, a second terminal coupled to the second terminal of the second P-type metal-oxide-semiconductor transistor, and a third terminal coupled to the second terminal of the fifth P-type metal-oxide-semiconductor transistor; and a fifth resistor having a first terminal coupled to the third terminal of the fifth P-type metal-oxide-semiconductor transistor, and a second terminal coupled to the ground.

25. The low dropout regulation system of claim 24, wherein the first N-type metal-oxide-semiconductor transistor and the second N-type metal-oxide-semiconductor transistor have the same process structure, and the second P-type metal-oxide-semiconductor transistor and the fifth P-type metal-oxide-semiconductor transistor have the same process structure.

26. The low dropout regulation system of claim 24, wherein the tracking voltage generation unit further comprises:

a first stabilization capacitor having a first terminal coupled to the third terminal of the third P-type metal-oxide-semiconductor transistor, and a second terminal coupled to the ground, wherein the first stabilization capacitor is used for stabilizing the first tracking voltage; and a second stabilization capacitor having a first terminal coupled to the third terminal of the fifth P-type metal-oxide-semiconductor transistor, and a second terminal coupled to the ground, wherein the second stabilization capacitor is used for stabilizing the second tracking voltage.

27. The low dropout regulation system of claim 24, wherein the first threshold voltage is equal to a threshold voltage of the second N-type metal-oxide-semiconductor transistor, and the second threshold voltage is equal to an absolute value of a threshold voltage of the fifth P-type metal-oxide-semiconductor transistor.

28. The low dropout regulation system of claim 24, wherein a ratio of the first resistor to the second resistor is equal to a ratio of the third resistor to the fourth resistor.

29. The low dropout regulation system of claim 24, wherein when the first voltage is greater than the first tracking voltage, the second voltage is equal to the first voltage.

30. The low dropout regulation system of claim 24, wherein when the first voltage is less than the first tracking voltage, the second voltage is equal to a supply voltage provided by a charge pump.

31. An operation method of a low dropout regulation system, the low dropout regulation system comprising a low dropout regulation unit, a tracking voltage generation unit, and a self-driving unit, the operation method comprising:

the low dropout regulation unit generating and outputting an inner output voltage according to a reference voltage;

the tracking voltage generation unit generating a first tracking voltage according to the reference voltage, wherein a voltage difference between the first tracking voltage and the inner output voltage is in positive correlation with constant times of a first threshold voltage of a first transistor within in the tracking voltage generation unit and is independent of the reference voltage; and the self-driving unit executing a corresponding operation according to the inner output voltage and the first tracking voltage.

32. The operation method of claim 31, wherein the self-driving unit executing the corresponding operation according to the inner output voltage and the first tracking voltage comprises when the voltage difference between the first tracking voltage and the inner output voltage is greater than the constant times of the first threshold voltage, the self-driving unit provides a compensation current to an output terminal of the low dropout regulation unit.

33. The operation method of claim 31, further comprising:

the tracking voltage generation unit generating the first tracking voltage and a second tracking voltage according to the reference voltage, wherein a voltage difference between the second tracking voltage and the inner output voltage is in positive correlation with constant times of a second threshold voltage of a second transistor within in the tracking voltage generation unit and is independent of the reference voltage; and the self-driving unit executing the corresponding operation according to the inner output voltage, the first tracking voltage, and the second tracking voltage;

wherein the self-driving unit executing the corresponding operation according to the inner output voltage, the first tracking voltage, and the second tracking voltage comprises:

when the voltage difference between the first tracking voltage and the inner output voltage is greater than the constant times of the first threshold voltage, the self-driving unit provides a first compensation current to the output terminal of the low dropout regulation unit; and when the voltage difference between the inner output voltage and the second tracking voltage is greater than the constant times of the second threshold voltage, the self-driving unit sinks a second compensation current from the output terminal of the low dropout regulation unit.

34. The operation method of claim 31, wherein the self-driving unit executing the corresponding operation according to the inner output voltage and the first tracking voltage comprises:

a body control signal being between a first voltage and a zero voltage, and the self-driving unit providing a compensation current to the output terminal of the low dropout regulation unit according to the inner output voltage, the first tracking voltage, and the body control signal when the low dropout regulation system is in an active mode; and the body control signal being equal to the zero voltage, and the self-driving unit being turned off not to provide the compensation current to the output terminal of the low dropout regulation unit according to the inner output voltage, the first tracking voltage, and the body control signal when the low dropout regulation system is in a standby mode.

* * * * *